US005488747A

United States Patent [19]

Woodhouse

[11] Patent Number: 5,488,747

[45] Date of Patent: Feb. 6, 1996

[54] BRUSH FOR CLEANING BOTTLES

[76] Inventor: Michael I. Woodhouse, 5910 Ranchero La., Dallas, Tex. 75236

[21] Appl. No.: 258,723

[22] Filed: Jun. 13, 1994

[51] Int. Cl.[6] ..... A46B 13/02

[52] U.S. Cl. ..... 15/23; 15/65; 15/179; 15/206

[58] Field of Search ..... 15/23, 24, 28, 15/29, 59, 65, 66, 206, 69, 164, 25, 26, 179; 403/42, 287, 301

[56] References Cited

U.S. PATENT DOCUMENTS

| | | | |
|---|---|---|---|
| 472,368 | 4/1892 | Koplin | 15/65 |
| 488,784 | 12/1892 | Zolper | 15/206 |
| 874,958 | 12/1907 | Goehns | 15/65 |
| 2,287,725 | 6/1942 | Conte | 15/23 |
| 2,792,579 | 5/1957 | Roy | 15/65 |
| 3,425,087 | 2/1969 | Fitzhugh | 15/28 |
| 3,472,490 | 10/1969 | Fitzhugh | 15/206 |

FOREIGN PATENT DOCUMENTS

| | | | |
|---|---|---|---|
| 802943 | 2/1951 | Germany | 15/23 |
| 139006 | 2/1920 | United Kingdom | 15/23 |

*Primary Examiner*—Edward L. Roberts, Jr.
*Attorney, Agent, or Firm*—W. J. Scherback

[57] ABSTRACT

A bottle brush including an elongated flexible rod having a plurality of stiff bristles at one end for contacting inside walls and base inner surface of a baby bottle. Connecting structure is provided on an opposite end of the rod to be received by a receptacle of a portable, hand-held motor of a food mixer and rigidly locked thereto for rapidly rotating the rod and bristles to clean the inner surfaces of the baby bottle.

2 Claims, 1 Drawing Sheet

BRUSH FOR CLEANING BOTTLES

BACKGROUND OF THE INVENTION

1. Field of the Invention

This invention relates generally to bottle cleaning devices and more particularly, to bottle cleaning devices known as bottle brushes.

2. Description of the Prior Art

Bottle brushes have been designed mounted on metal handles which require the user to hold a jar or bottle in one hand and the bottle brush in the other thereby making its use cumbersome. The user must physically insert and rotates by hand the brush in an attempt to clean the inside surfaces of the bottle or jar. The effort is tiresome and in many cases the inner surfaces are not thoroughly cleaned. This can present a problem in those instances where the bottle is a bottle used for feeding babies and the remanent of content, a baby formula, can spoil. Contamination can occur when the bottle is again filled with formula and the content fed to a baby.

U.S. Pat. No. 4,502,176 provides a bottle brush which can be attached to the center section of a double sink, thereby enabling an individual to wash bottles using one hand. But the individual still must physically place the bottle over the brush and rotate the bottle. This is no different than using a free brush when it comes to efficient and effective cleansing of the bottle.

U.S. Pat. Des. No. 334,287 illustrates a power driven bottle brush which could provide a more effective means to clean bottles. However, the design of the brush limits its use to a special type of bottle in order for the brush to be effective as a cleaning instrument. The design also would appear to require the use of a specially designed driver necessitating the purchase of the driver of limited application and the brush.

Accordingly, there exists the need of a bottle brush which will efficiently and effectively clean bottles, such as baby bottles, while avoiding manual manipulation of the brush and one which can be driven by universal readily available drivers.

SUMMARY OF THE INVENTION

The present invention comprises a flexible rod having a plurality of stiff bristles, preferably of nylon, at one end for contacting inside walls and base inner surface of a baby bottle. Connecting structure is provided on an opposite end of the rod to be received by a receptacle of a portable, hand-held food mixer and rigidly locked thereto for rapidly rotating the rod and the bristles to clean the inside walls and base inner surface of a baby bottle.

The connecting structure is a universal coupler for connection to a mating coupler of a portable, hand held electric food mixer.

One object of the present invention is to provide a bottle brush which may be attached to common, readily available drivers, such as portable electric mixers without modification to the driver.

Another object is to provide a bottle brush which may be purchased separate from a specific driver.

Yet another object is to provide a bottle brush which can be rotated by a portable electric mixer and easily attached to and removed from the mixer.

Still another object is to provide time and labor saving apparatus for cleaning bottles.

DETAILED DESCRIPTION

Figure 1:
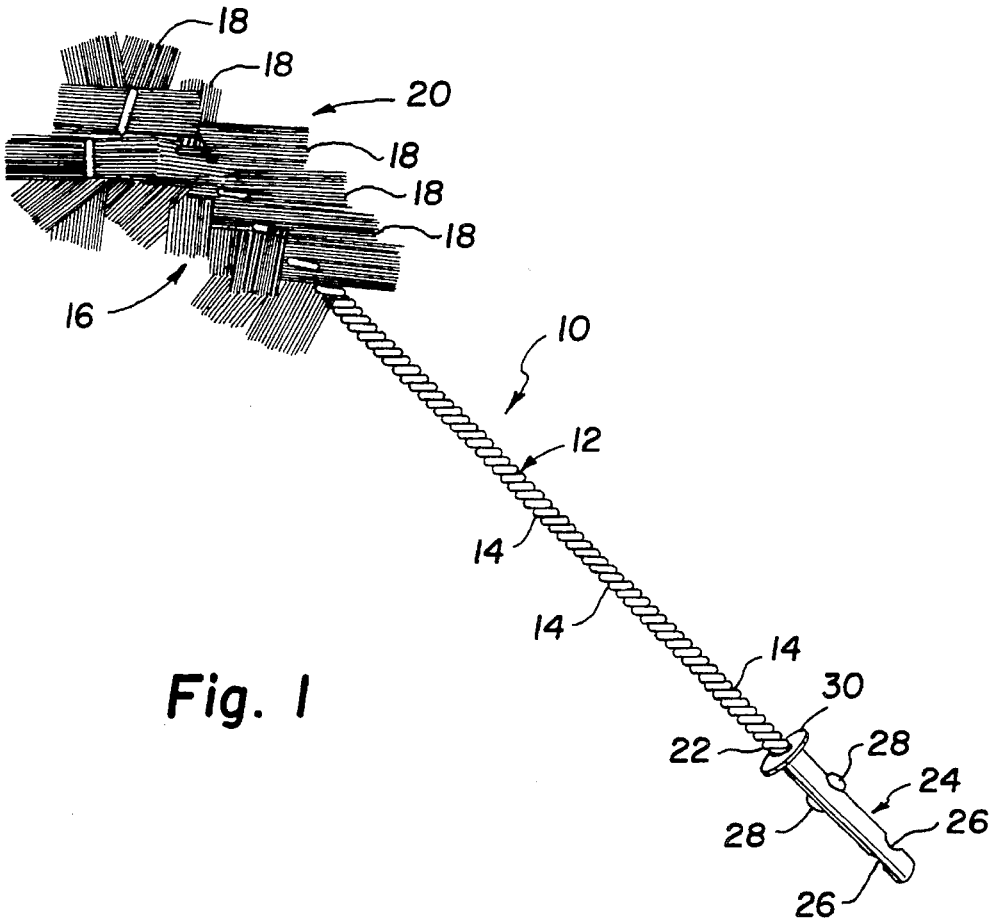
FIG. 1 is a perspective view of a bottle brush embodying features of the present invention.

A bottle brush 10 embodying features of the present invention is illustrated in FIG. 1. The bottle brush 10 comprises an elongate flexible rod 12, preferably formed by twisting a plurality of small diameter wires 14 together. The wires, of metal or plastic, may be wound or twisted about a central solid wire core (not shown). The wires preferably are of stainless steel to avoid corrosion. Fixed to one end 16 of the rod 12 are a plurality of bristles 18 which together form a cleaning head 20 of the brush 10. The bristles 18, preferably of Nylon, a trademark of DuPont, which is a highly elastic, very strong, synthetic material derived from coal, water and air, extend radially from the rod 12. The bristles 18 are secured to the rod 12 by interleaving them with the wires 14. The end 16 of the rod 12 is bent into an "L" shaped configuration to enhance the cleaning effectiveness of the brush by contacting the inside surfaces of a bottle, particularly at the bottom thereof.

Secured, as by welding, to an opposite end 22 of the rod 10 is a structure 24 designed to fit into a receptacle of a portable, hand held electrically powered, motorized food mixer. The structure 24 includes depressions 26, radial extensions 28 and a flange 30 which acts as a stop to limit the insertion distance of the structure 24 into the receptacle of the mixer. The receptacle of the mixer includes inner structure which mates with depressions 26 and radial extensions 28 to lock the brush to the mixer and hold it in position as the brush is rapidly rotated by the motor of the mixer.

Figure 2:
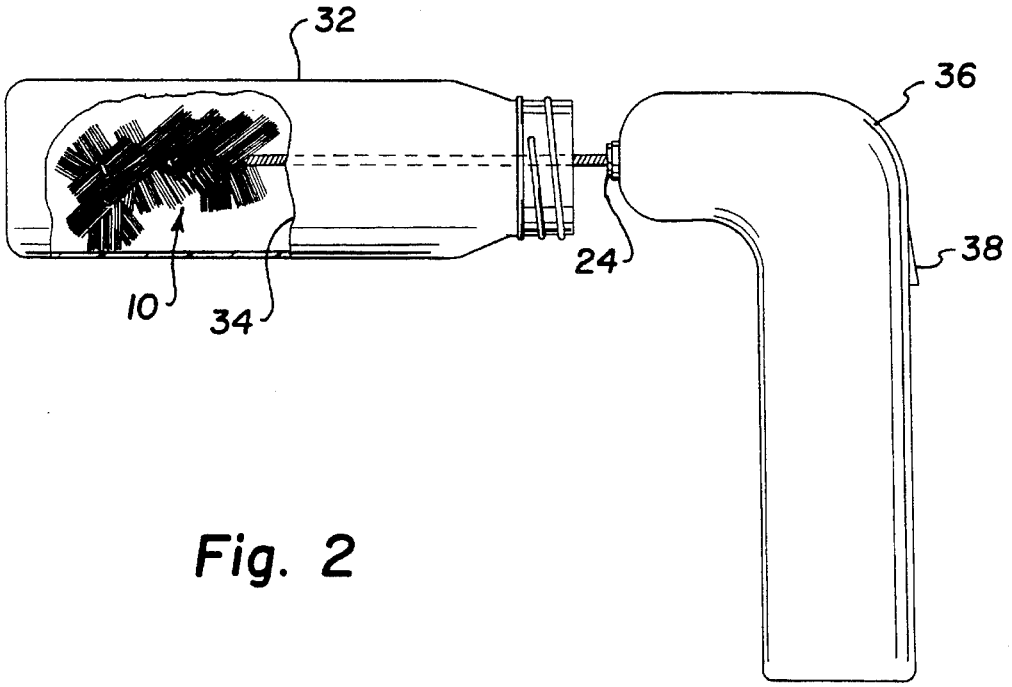
FIG. 2 illustrates the bottle brush of FIG. 1 inserted in a baby bottle for cleaning the same and being connected to a typical hand-held electrically powered driver of the type associated with food mixers.

The application of the present invention to clean bottles is illustrated in FIG. 2. The bottle brush 10 of the invention is shown inserted into a baby bottle 32 which is partially cut away at 34 to show the position of the brush. The end structure 24 is connected into a receptacle of a hand-held, portable, electrically powered unit 36 of a typical food mixer. Hand-held food mixers of the type referred to are to be found in many homes. Therefore it is unnecessary for an operator to purchase another driver to practice the invention. The unit 36 is battery operated , but is merely exemplary of other units which are a.c. powered. With the brush in the position shown, switch 38 is engaged to excite the motor and rapidly rotate the brush 10 to clean the inside surfaces of the bottle 32. As a result the surfaces of the bottle are rapidly and efficiently cleaned with little effort on the part of the operator. This is a marked difference to the laborious hand operated method of physically rotating the brush.

What is claimed is:

1. A baby bottle brush comprising;

a flexible rod, bristles attached to one end of said rod, and solid metal connecting structure at an opposite end of said rod for attaching said brush to a motor of a hand-held portable food mixer for rapidly rotating said brush to clean inside surfaces of the bottle, said connecting structure comprising two depressions formed near an end of said connecting structure and spaced 180 degrees apart, a pair of radial extensions formed on said connecting structure spaced 180 degrees apart and also spaced from said depressions toward said bristles, and a flange on said connecting structure spaced from said radial extensions in direction toward said bristles to act as a stop to limit travel of said connecting structure toward the motor.

2. A electrically driven baby bottle brush assembly comprising an electrically powered hand-held portable food mixer motor including a receptacle, a flexible rod, bristles attached to one end of said rod, solid metal connecting structure at an opposite end of said rod for attaching said brush to said receptacle of said motor for rapidly rotating said brush to clean inside surfaces of a bottle, said connecting structure comprising two depressions formed on and near an end of said connecting structure and spaced 180 degrees apart, a pair of radial extensions formed on said connecting structure spaced 180 degrees apart and also spaced from said depressions toward said bristles, and a flange on said structure spaced from said radial extensions in direction of said bristles to act as a stop to limit travel of said connecting structure toward said receptacle.

* * * * *